US005842675A

United States Patent [19]

Davitt

[11] Patent Number: 5,842,675

[45] Date of Patent: Dec. 1, 1998

[54] UNIVERSAL BASE COVERING FOR METAL CONTAINERS

[76] Inventor: J. Alan Davitt, 442 15th Ave. North, Jacksonville Beach, Fla. 32250

[21] Appl. No.: 873,873

[22] Filed: Jun. 12, 1997

[51] Int. Cl.[6] ..... F16M 13/00

[52] U.S. Cl. ..... 248/346.5; 248/687; 248/346.11; 220/701; D7/624

[58] Field of Search ..... 248/346.11, 687, 248/146, 346.04, 357; 220/700, 701, 730, 733, 737; 206/139, 504, 144; 215/10, 376, 398; D7/624

[56] References Cited

U.S. PATENT DOCUMENTS

| | | | |
|---|---|---|---|
| D. 353,975 | 1/1995 | Gooch | D7/624 |
| 1,924,926 | 8/1933 | Gray | D7/624 X |
| 2,131,878 | 10/1938 | Lawrence | D7/624 X |
| 2,683,579 | 7/1954 | Wallace | 248/146 |
| 2,685,318 | 8/1954 | Merkle | D7/624 X |
| 2,731,056 | 1/1956 | Anson | D7/624 X |
| 3,419,240 | 12/1968 | Santic | 248/687 X |
| 5,150,869 | 9/1992 | Gould et al. | 248/346.11 |
| 5,285,996 | 2/1994 | Waller | 248/346.11 X |

*Primary Examiner*—Ramon O. Ramirez
*Assistant Examiner*—Long Dinh Phan
*Attorney, Agent, or Firm*—Robert J. Doherty

[57] ABSTRACT

A combination structure of a container and a base covering wherein the container is a metal container susceptible to rust and is provided with a flexible cup-shaped and completely imperforate covering on the lower portion thereof which covering includes a lower portion extending across the base of the container wall and upwardly into the recess provided therein so as to avoid interference with the normal upright positioning of the container and covering combination yet still provide for a scratch proof and rust preventing covering therefore.

6 Claims, 5 Drawing Sheets

UNIVERSAL BASE COVERING FOR METAL CONTAINERS

BACKGROUND OF THE INVENTION

1. Field of the Invention

This invention relates generally to a base for a metallic container or can. More specifically, this invention relates to a universal, underside elastic and flexible covering which readily conforms to the entire bottom region or base of any circular metallic container such as an aerosol can and within a large range of can diameters. Thus applied to the can, the cover prevents or retards the formation of rust in the covered areas and subsequently rust deposits or rings upon the surface on which such can rests.

2. Description of the Prior Art

There has long been coaster-type holders for containers primarily designed for condensation control. This invention could be used for such purposes of condensation control but was designed for containers subject to humid, moisture rich environments and as such should not and was not intended to be considered a coaster. However, the following structures which can be referred to as coasters are known to the present applicant. One such coaster is that of Ige, U.S. Pat. No. 5,056,749. Ige discloses a coaster which is attached to containers, primarily coffee cups, whose diameters are "slightly" larger than the coaster's diameter. The coaster of Ige is restricted to containers or coffee cups with approximately the same (actually slightly larger) diameter as that of the disclosed coaster. Ige also includes a hole in the bottom of the coaster to aid in quick and easy removal. This opening exposes portions of the container's base or underside which could potentially rust and leave unsightly and difficult to remove rust deposits.

U.S. Pat. No. 2,683,579 to Wallace relates to a base or holder for "cleanser" cans, Wallace's objective is to increase can stability to prevent tipping in addition to providing a cushion to protect porcelain from chipping. To give containers this added stability feature, Wallace's holder has a rim which protrudes or extends outward from the base of the can. This rim feature which is described as rigid, like that of Ige, severely limits the adaptability of the Wallace device to cans with approximately the same diameter as the holder. Additionally, this rim feature once affixed to the container extends or increases the diameter of the can. This increase in diameter could render cans too large to be stored in such places as overcrowded bathroom shelves or narrow medicine cabinets. Also, the Wallace holder has an intricate securing mechanism which in addition to diameter restrictions previously discussed further limits the device to containers with protruding base rings or lips.

The patent to Waller, U.S. Pat. No. 5,285,996, describes a lower rim guard for metal cans. The Waller rim guard is designed for containers with bottom rims or lips which the device "snaps" onto. The rim guard due to its "stiff resilient" composition is further limited to containers of approximately the same diameter as the rim guard. Waller identifies aluminum as a possible material for the construction of the device's primary channel member which further supports the device's limited size adaptability. Since Waller's device is a ring-type design in shape, the majority of the can's bottom is exposed and subject to moisture with the potential for rust to form and eventually be deposited.

In light of the above patents, it is thus clearly evident that a need still exists for a device which when utilized with metal cans as above described will prevent the formation and deposit of rust spots on supporting surfaces such as bathroom counters and which will simultaneously cushion the direct contact between such supporting surfaces and the lower rim of such cans which could, if otherwise unprotected, cause scratch marks and the like.

It is, therefore, an objective of the present invention to provide a universal, that is, one size fits all, base underside covering for metal cans within a large range of various diameters with or without base lips or rims to prevent the formation of rust deposits or rings on the container's supporting surface.

It is another objective of the present invention to provide such a base underside covering that covers and conforms to the entire base or bottom region of the container thus leaving no area exposed to water or atmospheric moisture.

It is still another objective of the present invention to provide such a base underside covering that is simple in design making it extremely adaptable.

It is finally an objective of the present invention to provide such a base underside covering that is durable, versatile, attractive in appearance and inexpensive to manufacture.

SUMMARY OF THE INVENTION

The above and further objects of the present invention are accomplished by the provision of a combination structure of a container and a base covering therefore wherein said container is a metal container of the type susceptible to rusting in a humid atmosphere and having a lower portion including a base wall at the lower terminus of said lower portion and including a circular peripheral rim having a lower surface adapted to contact a supporting surface whereby the container is positioned in an upright position and a circular side wall upwardly extending from said rim and wherein said base wall includes a central recess formed by portions thereof upwardly recessed from said rim lower surface, said base covering comprising a flexible and deformable inverted dome shaped imperforate cup having a body wall defining an open neck of a diameter smaller than that of said container base wall in its unflexed state and wherein said body wall includes an inner surface and wherein said cup is positioned on said container lower portion so as to cover said rim and bottom portions of said base wall with said open neck stretched to accommodate said container base and wherein bottom portions of said cup inner surface are upwardly received in said central recess and in at least partial face to face contact with said base wall so as to completely cover said container lower portion including said base wall and said rim, and wherein said bottom portions of said cup positioned within said recess remain flexible but unstretched.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
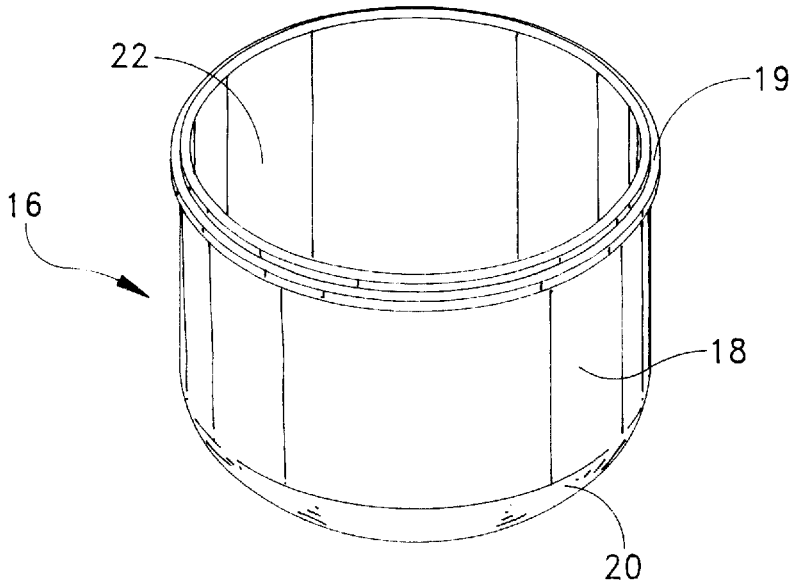
FIG. 1 is a front perspective view of the base covering portion of the present composite structure.
Figure 2:
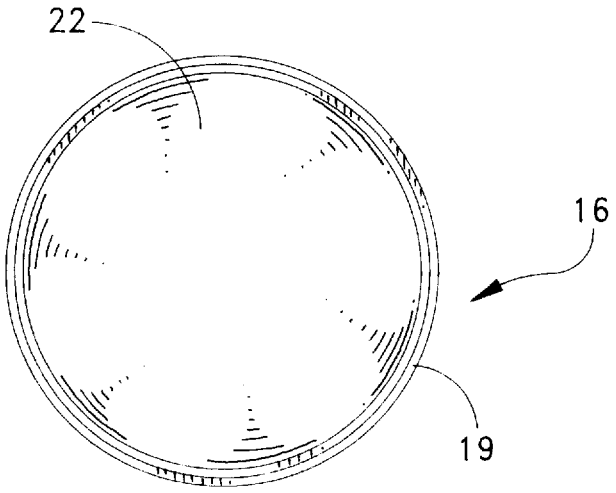
FIG. 2 is a top plan view thereof.
Figure 3:
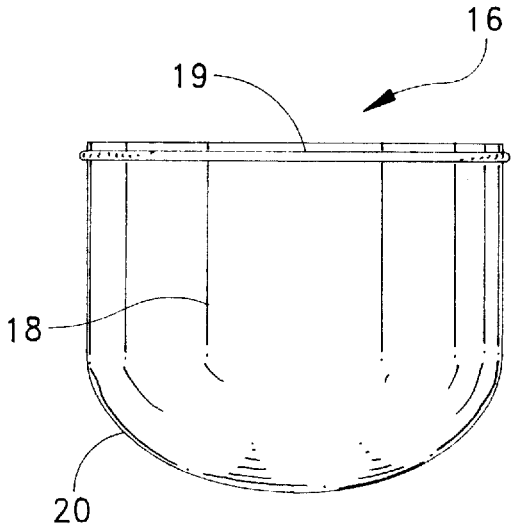
FIG. 3 is a front elevational view thereof.
Figure 8A:
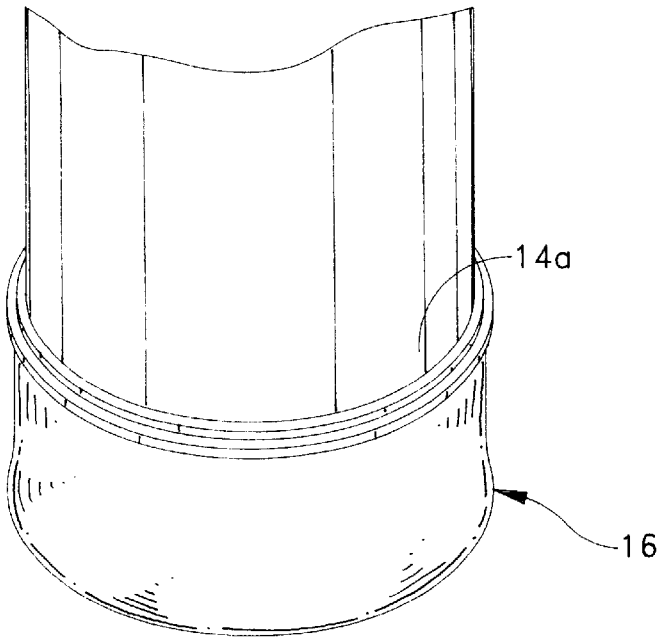
FIG. 8A is a view similar to FIG. 8 showing the same size base covering as in FIG. 8 but mounted on a smaller diameter can.
Figure 8:
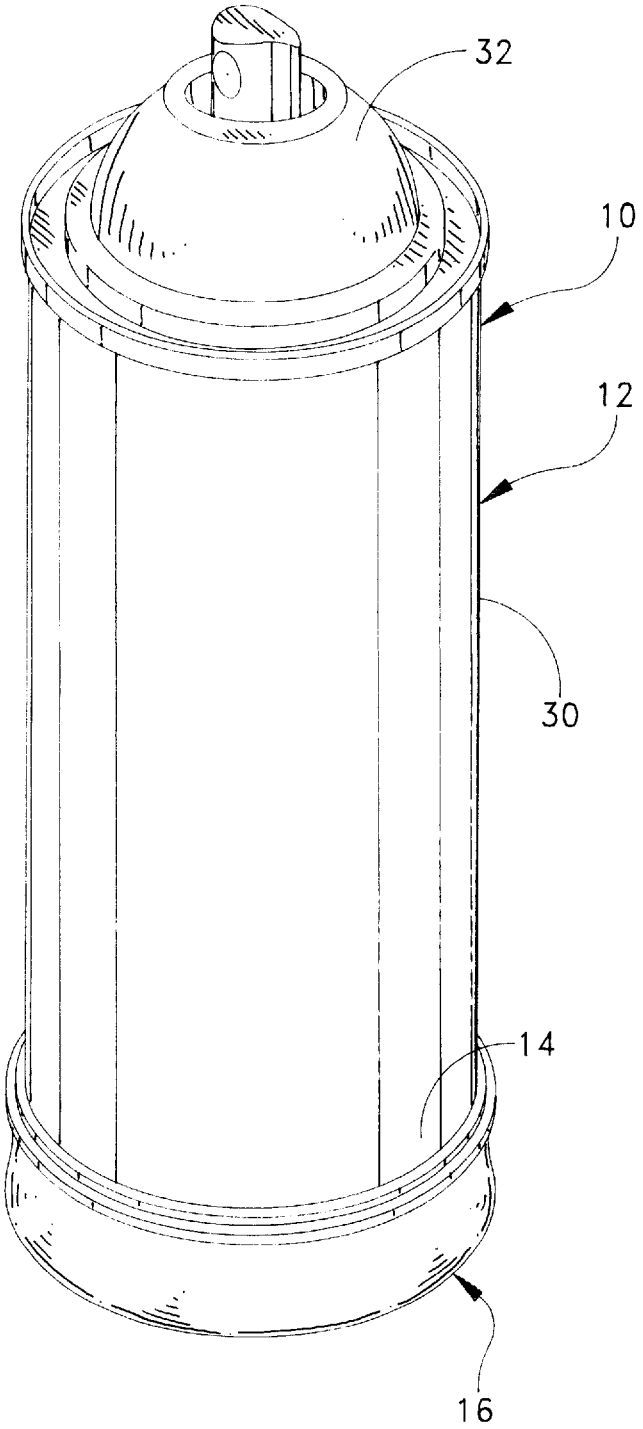
FIG. 8 is a front perspective view showing an aerosol can and a base covering mounted on the lower portion thereof.

Referring to the drawings and particularly FIG. 8 thereof, a combination structure 10 of the present invention is depicted as including an aerosol can 12 having a lower portion 14 in part covered by a base covering 16. Such base covering 16, as best depicted in FIGS. 1 through 3 of the drawings, is in the form of a cup preferably of inverted dome shape and including an imperforate body wall 18 in turn having lower portions 20. Preferably, the base covering 16 is in the dome configuration depicted although in some cases a straight cylindrical shape may be adequate as when coupled to containers having a relatively straight base wall rather than a pronounced upwardly arcuately shaped and recessed base wall for which the dome shape configuration body wall lower portion 20 is particularly adapted to extend thereinto as will be further explained.

The upper portion of the cup includes an open neck 22 of a diameter at least slightly less and possibly significantly less dependent on its ability to stretch than that of the diameter of the can lower portion for which it is adapted to be received thereon. Cup 16 is also preferably formed from a stretchable, that is, deformable, rubber or rubber-like material which when relaxed, that is, the stretch force removed therefrom, will allow the cup to return to its normal shape and size. Dependent upon the inherent stretchiness of such material, the cup can be made to easily adapt in size and thus fit a wide range of container lower portions including those that are materially larger in diameter than that of the open neck 22. In addition, the height of the body wall 18 is such that the cup 16 can be adequately mounted on the lower portion of the container yet still have sufficient material remaining to extend across the lower rim of the container and at least extend partially upwardly into the recess formed by the container bottom.

Figure 6:
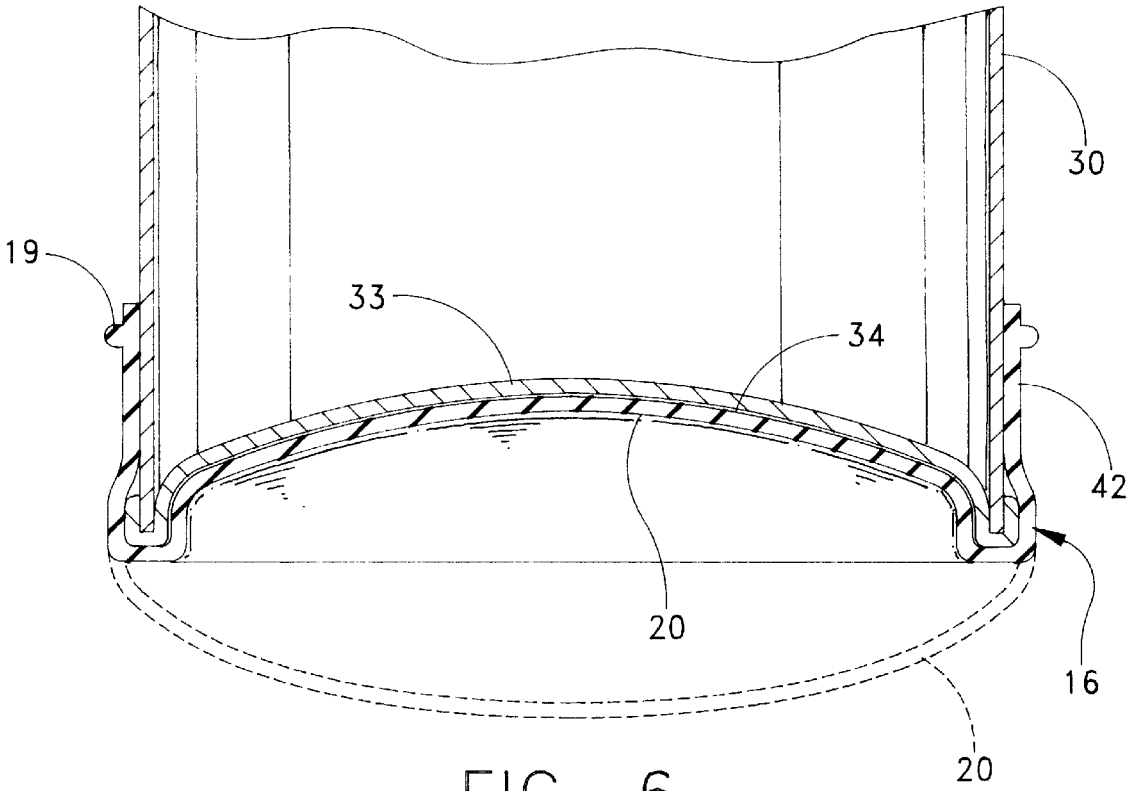
FIG. 6 is a cross-sectional view along the line 6—6 of FIG. 5.
Figure 7:
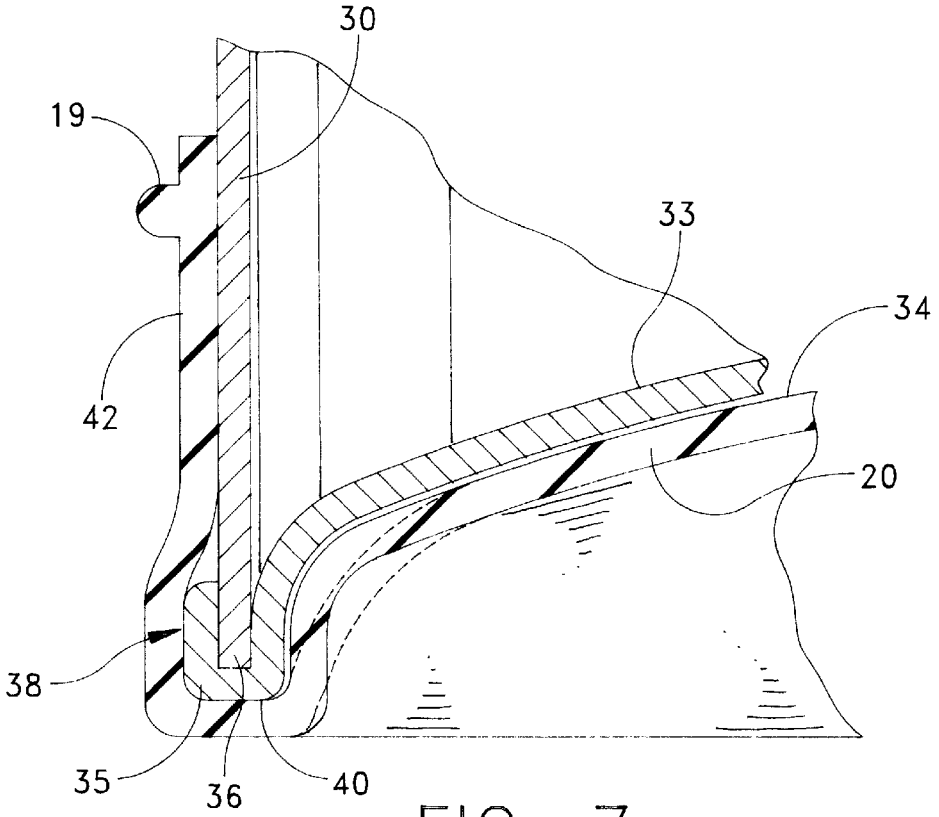
FIG. 7 is an enlarged partial view of FIG. 6 and showing in dosed lines an alternate configuration or path that the body wall of the base covering may assume.

The container 12 as shown in FIGS. 4 through 7 is depicted in the form of an aerosol can having a body wall 30, a dispensing top 32 sealingly clenched thereto by known means and a base wall 33 sealingly clenched to the lower rim 36 of the container wall 30 by conventional means including the simple clench shown in FIGS. 6 and 7 and may also include the form which is referred to as a double curl or by any other standard means for attaching the container base 33 to the side walls 30 thereof. The side walls 30 and the base 33 could also be integrally formed as a one-piece structure. In any event, the above described co-action between the terminal end 36 of the container and the peripheral edges 35 of the container base wall 33 cooperate to form a rim 38. The lower surface 40 of the rim 38 forms the surface on which the container is normally supported in an upright position as on a bath or kitchen counter, and it is this surface as well as the entire base wall surface 33 and the lower portions of the container itself that is desired to be protected since under normal circumstances, it is these areas that are most likely to exhibit rust and leave rust spots or rings brought about either by the direct contact of the rim lower portion on such supporting surfaces or by condensation picking up such rust or other contamination as the condensation rolls down the side of the can particularly the lower portions thereof.

Figure 4:
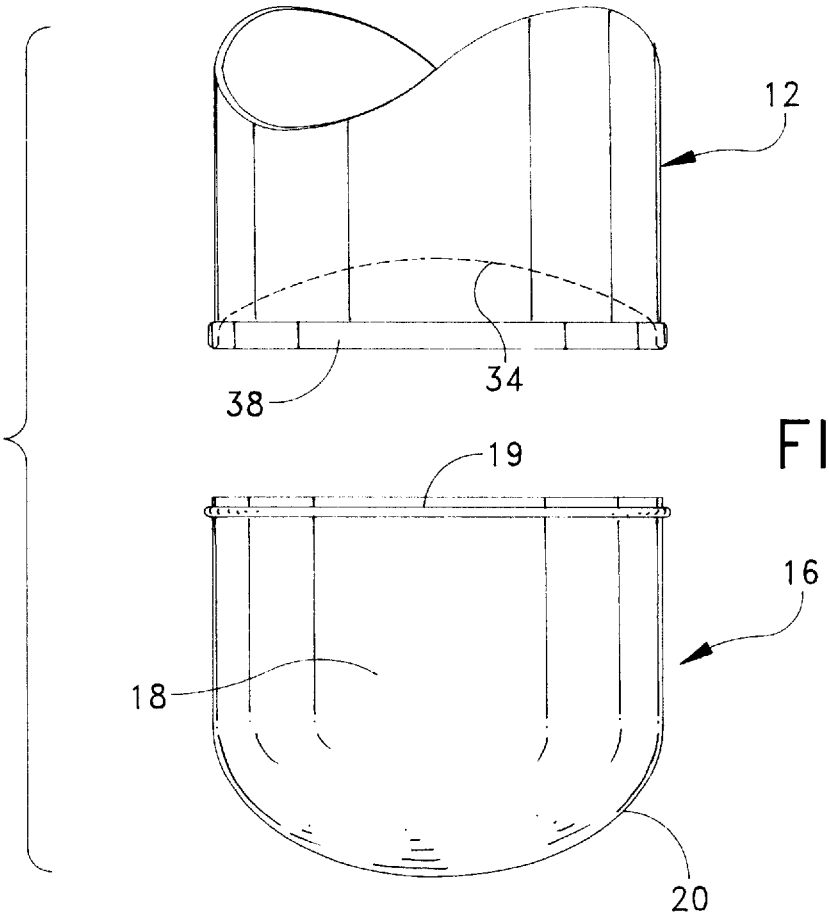
FIG. 4 is a front elevational view of the container and base covering vertically aligned before the base covering is stretched to, in effect, be mounted upon the container lower portion.
Figure 5:
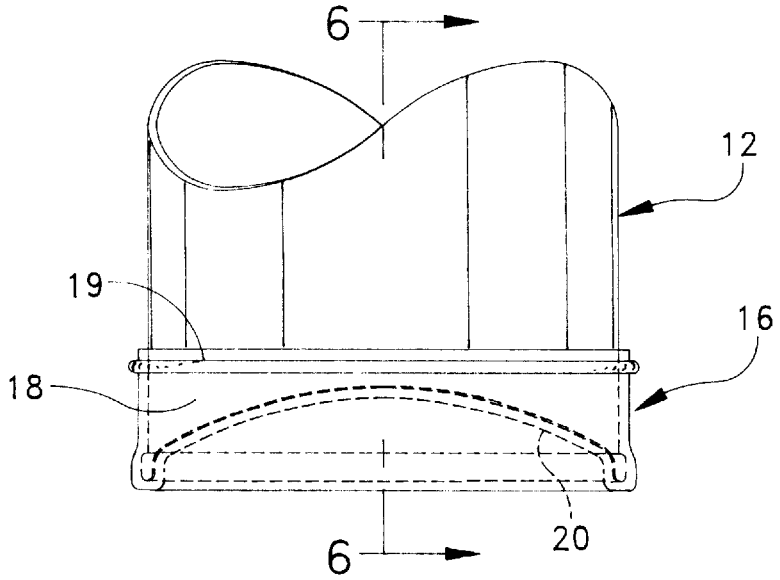
FIG. 5 is a front elevational view showing the container and base portion in assembled position.

In order to protect the aforementioned container lower portions, the base covering, that is, the cup 16 as shown in FIGS. 1 through 3, is positioned as shown in FIG. 4 and then the neck 22 stretched and the upper portions of the cup body 18 progressively worked up the lower portions 14 of the container side wall 30 until those upper portions 42 are juxtaposed in face to face relation with at least enough of a height on the side wall 30 in order to be securely fastened thereto. It is also preferable to move the upper portions 42 into a height position such that a substantial excess portion made up of the bottom portion 20 of the cup 16 shown by the dotted lines in FIG. 6 is available for being pushed upwardly into the recess 34 defined by the upward doming of the base wall 33 as shown in the drawings such that such excess material does not interfere with the upright positioning of the container and base covering combination as depicted. That is, such excess material could droop downwardly and potentially interfere with the intended stable upright positioning of the can and covering combination. Also as there is a somewhat tight fit between the covering neck 22 and the side walls 30, it is usually necessary and desirable to upwardly push the excess bottom material upwardly while stretching the neck outwardly a bit to, in effect, provide an escape path for air trapped in the recess 34 by the bottom 20 and thus, in effect, "burp" the covering.

Figure 7A:
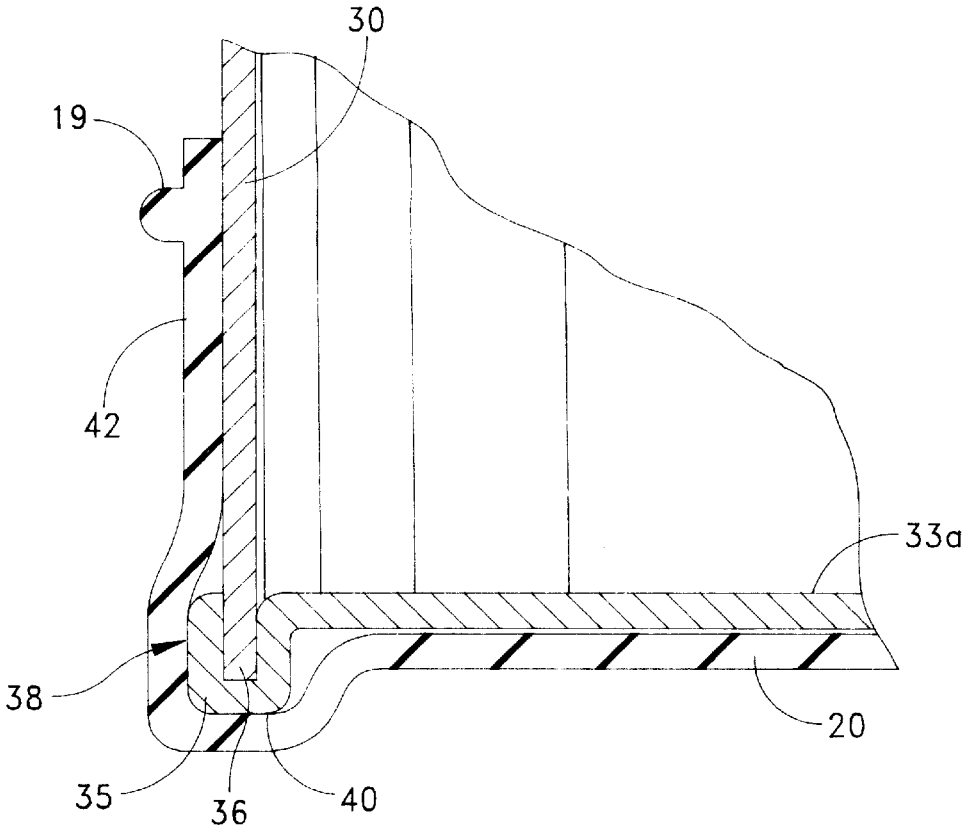
FIG. 7A is an enlarged partial view similar to FIG. 7 but showing an alternate form of can bottom configuration.

It should also be pointed out that instead of the pronounced dome or recess 34 formed by the base wall 33, such base wall particularly in the cases of non-aerosol containers may be formed of a substantially flat configured base wall 33*a* as shown in FIG. 7A in which case only a slight recess above the bottom 40 of the rim 38 would be present, and it would be into this lessened recess that the excess material from the bottom 20 of the cup wall 18 would be pressed. As previously indicated, air is sometimes trapped between the bottom 20 of the cup body 18 and the outer surfaces of the base wall 33 or 33*a* as well as the lower portions of the container and that in such cases the upper portion 42 of the cup can be simply outwardly manipulated while simultaneously depressing the lower portion 20 to vent such air and assure a relatively close fitment of the bottom portions 20 to, in effect, create a vacuum within the recess, and such vacuum permits a tighter adhesion to the base wall 33 or 33*a* or at least makes it less likely that the material forming the cup bottom 20 will droop downwardly. This action assists in preventing rust as well as the likelihood of rust contacting the supporting surfaces for the can and its covering.

Also as noted in FIG. 7, the dotted line representation depicts the configuration which the lower portion 20 of the cup 16 often takes especially with embodiments wherein the rubber or rubber-like material is particularly flexible or when the cup 16 body wall 18 is made from particularly thin material. In this regard, it should also be pointed out that it is preferable for manufacturing costs reasons to construct the cup 16 of equal thickness throughout although such certainly can be altered as desired as for reinforcing when necessary as per the addition of the circular bead 19 positioned proximal the open neck 22 thereof. Also as shown in FIG. 8A, the relatively higher positioning of the cup on the can side walls 30 is depicted when utilizing a smaller can diameter. This in part illustrates the one size fits all (within reason) intention of the invention.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination structure including a container and a base covering wherein said container is a metal container of the type susceptible to rusting in a humid atmosphere and having a lower portion including a base wall at a lower terminus of said lower portion and including a circular peripheral rim having a lower surface adapted to contact a supporting surface whereby the container is positioned in an upright position and a circular side wall upwardly extending from said rim and wherein said base wall includes a central recess formed by portions thereof upwardly recessed from said rim lower surface, said base covering comprising a flexible and deformable inverted dome shaped imperforate cup having a body wall defining an open neck of a diameter smaller than that of said container base wall in its unflexed state and wherein said body wall includes an inner surface and wherein said cup is positioned on said container lower portion so as to cover said rim and bottom portions of said base wall with said open neck stretched to accommodate said container base and wherein bottom portions of said cup inner surface are upwardly received in said central recess and in at least partial face to face contact with said base wall so as to completely cover said container lower portion including said base wall and said rim, and wherein said bottom portions of said cup positioned within said recess remain flexible but unstretched.

2. The combination structure of claim 1, wherein said cup is formed of a soft rubber material which will return to its original dome shape when undeformed.

3. The combination structure of claim 2, said cup body wall of relatively equal wall thickness throughout the extent thereof.

4. The combination structure of claim 1, wherein said container, having a relatively straight side wall and said rim generally aligned with said side wall.

5. The combination structure of claim 2, wherein said cup is of a cylindrical shape.

6. The combination structure of claim 1, wherein a partial vacuum is present between the container base wall and the bottom portions of the cup inner surface.

* * * * *